US008022917B2

(12) United States Patent
Lin et al.

(10) Patent No.: US 8,022,917 B2
(45) Date of Patent: Sep. 20, 2011

(54) LCD PANEL DRIVING METHOD AND DEVICE WITH CHARGE SHARING

(75) Inventors: Kun-Tsung Lin, Taichung (TW); Kuei-Kai Chang, Jhubei (TW); Bo-Wen Wang, Hsinchu (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 892 days.

(21) Appl. No.: 11/439,278

(22) Filed: May 24, 2006

(65) Prior Publication Data

US 2006/0274013 A1 Dec. 7, 2006

(30) Foreign Application Priority Data

Jun. 7, 2005 (TW) ..... 94118734 A

(51) Int. Cl.
*G09G 3/36* (2006.01)

(52) U.S. Cl. ..... 345/98; 345/100

(58) Field of Classification Search ..... 345/87, 345/96, 98, 100; 349/33–43
See application file for complete search history.

(56) References Cited

U.S. PATENT DOCUMENTS

| | | | | |
|---|---|---|---|---|
| 6,549,186 | B1 * | 4/2003 | Kwon | 345/95 |
| 6,778,158 | B2 * | 8/2004 | Sun | 345/87 |
| 7,369,187 | B2 * | 5/2008 | Park | 349/38 |
| 2004/0263466 | A1 * | 12/2004 | Song et al. | 345/100 |
| 2004/0263507 | A1 * | 12/2004 | Sun | 345/212 |
| 2005/0140637 | A1 * | 6/2005 | Yi | 345/98 |
| 2006/0164375 | A1 * | 7/2006 | Kim et al. | 345/100 |
| 2006/0262069 | A1 * | 11/2006 | Do et al. | 345/98 |
| 2007/0001957 | A1 * | 1/2007 | Moon et al. | 345/92 |

* cited by examiner

*Primary Examiner* — Chanh Nguyen
*Assistant Examiner* — Kwang-Su Yang
(74) *Attorney, Agent, or Firm* — Bacon & Thomas, PLLC

(57) ABSTRACT

An LCD panel driving method and device with charge sharing is disclosed. The LCD panel includes a plurality of switches, a plurality of data lines, a signal driving circuit for generating a plurality of image signals, a charge sharing common voltage driving circuit and a common capacitor having one end connected to the charge sharing common voltage driving circuit through a common voltage node. The method turns the switches on to thereby form the charge sharing common voltage driving circuit and the signal driving circuit as a short circuit, such that charges stored in the common capacitor flow into the data lines to drive the common voltage node to enter in an inverse phase state in order to sequentially turn the switches on and then off to accordingly sample the respective data lines.

13 Claims, 7 Drawing Sheets

LCD PANEL DRIVING METHOD AND DEVICE WITH CHARGE SHARING

BACKGROUND OF THE INVENTION

1. Field of the Invention

The invention relates to a technical field of flat displays and, more particularly, to an LCD panel driving method and device with charge sharing.

2. Description of Related Art

Current portable electronic products, such as PDAs, MP3 players and the like, are getting more and more popular with the development of the electronics industry. In general, the portable electronic products typically are equipped with a small-scale liquid crystal display (LCD), such as a thin-film transistor LCD (TFT-LCD).

FIG. 1 is a schematic diagram of a typical TFT-LCD panel. The panel includes four scan lines (SL1-SL4) 102, three data lines 104, twelve pixels 106, a gate driving circuit 108, a signal driving circuit 110, a common voltage driving circuit 126, three switches (SW1R, SW2R, SW3R) 112, a switch control circuit 114 and a common capacitor 116. Each pixel 106 has a transistor 118 and a capacitor 120 to store charges. Each data line 104 has parasitic resistors 122 and parasitic capacitors 124.

The ends of each capacitor 120 are connected to the respective electrodes at two ends of a liquid crystal (not shown). The transmittance of a liquid crystal is changed by changing the voltage stored in the respective capacitor 120. Further, each capacitor 120 has one end connected to a drain of a respective transistor 118 and the other commonly connected to a common voltage node Vcom, and the transistor 118 has a source connected to a data line 104 and a gate connected to a scan line 102. The panel is driven by first using the gate driving circuit 108 to send a switch voltage to the scan lines 102 in order to sequentially turn the transistors 118 on, then using the switch control circuit 114 to sequentially switch the switches 112 on, and finally using the signal driving circuit 110 to sent a voltage to the data lines 104 in order to charge the capacitors 120 through the respective transistors 118, thereby reaching a specific voltage.

To prevent a liquid crystal from being dissolved and becoming unusable, an alternating current (AC) power is typically used to drive an LCD. One well-known technique is the common voltage swing drive method. Namely, a voltage of each data line 104 is alternately higher and lower than a voltage of the common voltage node Vcom, and accordingly the liquid crystals receive alternate positive and negative driving of the AC to thus prevent a damage from being driven by a direct current (DC) voltage. FIG. 2 is a diagram of voltage waveforms of a data line 104 and the common voltage node Vcom. FIG. 3 is a flowchart of the common voltage swing drive method. FIG. 4 is a diagram of waveforms that are presented on nodes T1-T4 when using the common voltage swing drive method. As shown in FIG. 4, when the common voltage node Vcom is phase inverted, the signal driving circuit 110 requires driving the data lines to a target voltage, which consumes much power and has a very long rising time.

SUMMARY OF THE INVENTION

The object of the invention is to provide a liquid crystal display (LCD) panel driving method and device with charge sharing, which reduces the power consumption caused by parasitic capacitors of data lines to thus save the power.

In accordance with one aspect of the invention, a liquid crystal display (LCD) panel driving device with charge sharing is provided, which includes a plurality of scan lines, a plurality of data lines, a plurality of pixels, a signal driving circuit, a plurality of switches, a switch control circuit, a charge sharing common voltage driving circuit and a common capacitor. The scan lines are arranged in rows, and the data lines are arranged in columns and intersect with the scan lines respectively. Each pixel locates on an intersection of a scan line and a data line. The signal driving circuit produces a plurality of image signals. The switches are coupled to the signal driving circuit and the data lines such that the image signals are sent to the data lines when the switches are on. The switch control circuit is connected to the switches in order to produce a plurality of sampling signals to thereby control the switches to be on or off. The charge sharing common voltage driving circuit is connected to the signal driving circuit. The common capacitor has a first terminal connected to the pixels and the charge sharing common voltage driving circuit through a common voltage node, and a second terminal connected to ground. The charge sharing common voltage driving circuit and the signal driving circuit form a short circuit at charge sharing, and the switch control circuit controls the switches to be on in order to neutralize charges stored in the common capacitor with charges on the data lines.

In accordance with another aspect of the invention, a driving method with charge sharing for a liquid crystal display (LCD) panel is provided. The LCD panel includes a plurality of switches, a plurality of data lines, a signal driving circuit to produce a plurality of image signals, a charge sharing common voltage driving circuit and a common capacitor. The common capacitor has a terminal connected to the charge sharing common voltage driving circuit through a common voltage node. The method includes the steps of: (A) turning the switches on; (B) forming the charge sharing common voltage driving circuit and the signal driving circuit to be a short circuit in order to neutralize charges stored in the common capacitor with charges on the data lines; (C) driving the common voltage node to be in an inverse phase; and (D) sequentially turning the switches on and then off to accordingly sample the respective data lines.

Other objects, advantages, and novel features of the invention will become more apparent from the following detailed description when taken in conjunction with the accompanying drawings.

DETAILED DESCRIPTION OF THE PREFERRED EMBODIMENT

The invention uses the charge sharing to reduce the power consumption in an LCD panel. Namely, when the voltage of a common voltage node Vcom is in an inverse phase, data lines and the common voltage node Vcom are short-circuited to thereby neutralize the charges and reduce charging to the data lines and a common capacitor.

Figure 1:
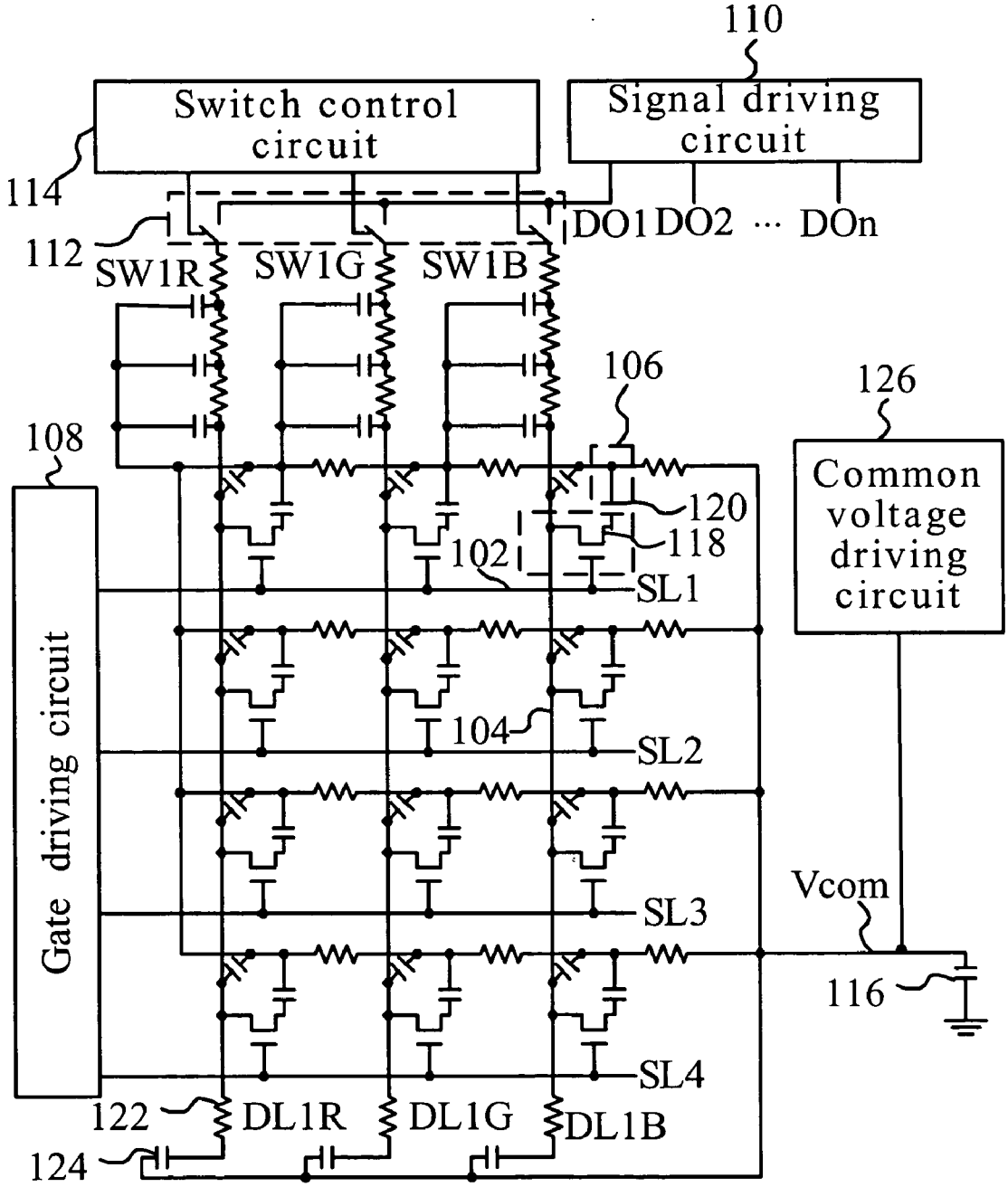
FIG.1(Prior art)
FIG. 1 is a schematic diagram of a typical TFT-LCD panel.
Figure 2:
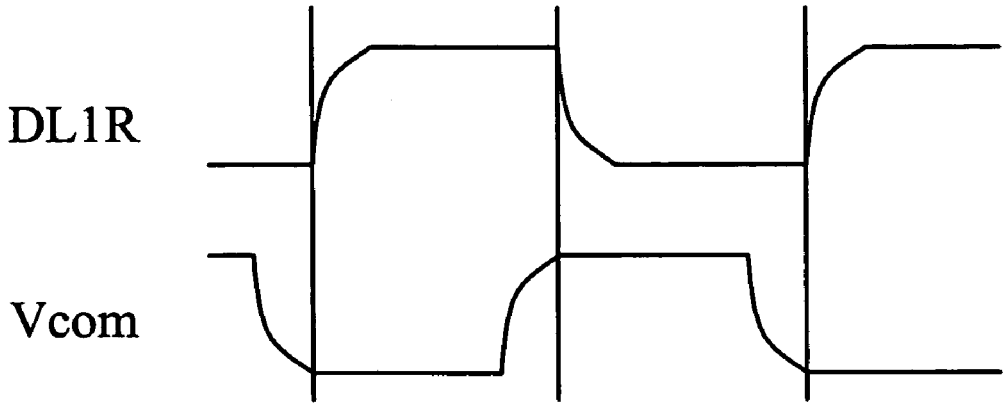
FIG.2(Prior art)
FIG. 2 is a diagram of voltage waveforms of data line and common voltage node.
Figure 3:
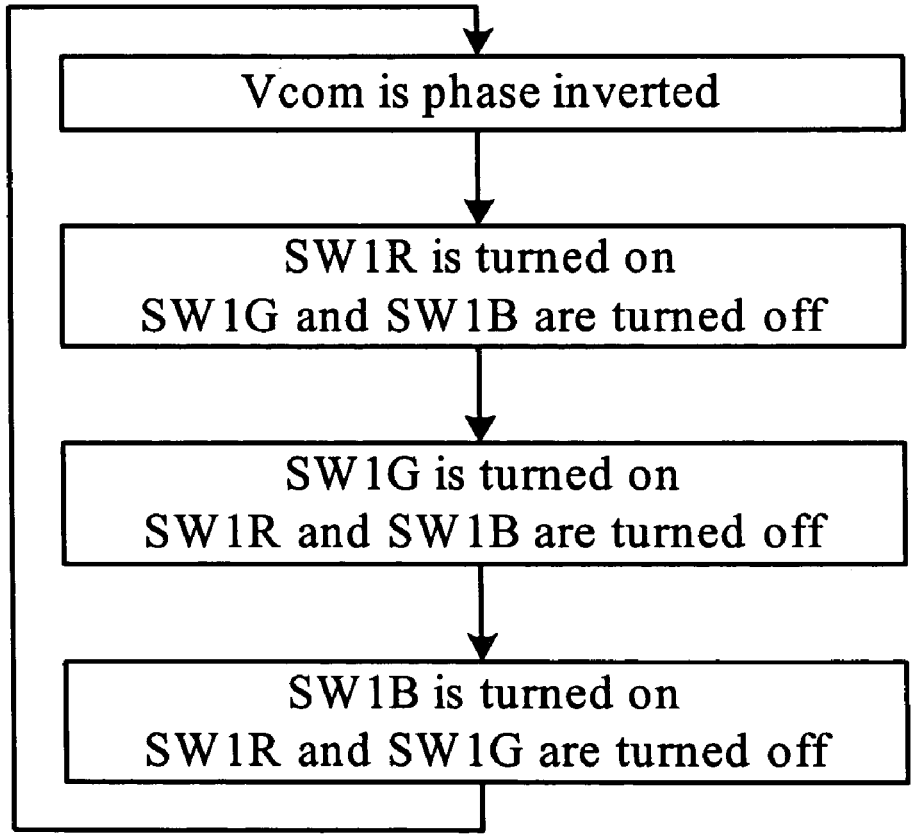
FIG.3(Prior art)
FIG. 3 is a flowchart of a typical common voltage swing drive method.
Figure 4:
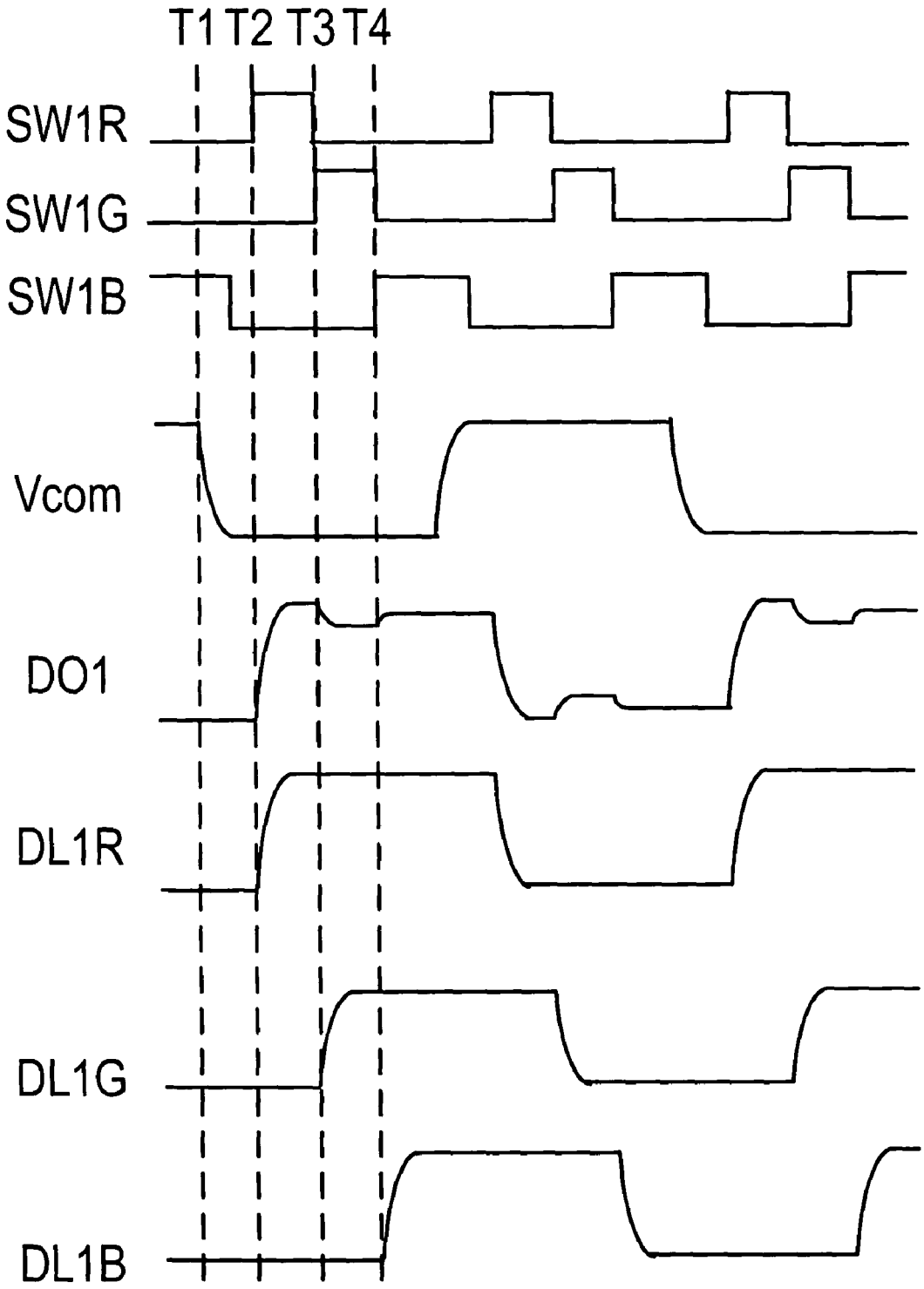
FIG.4 (Prior art)
FIG. 4 is a diagram of waveforms that are presented on nodes when using a typical common voltage swing drive method.
Figure 5:
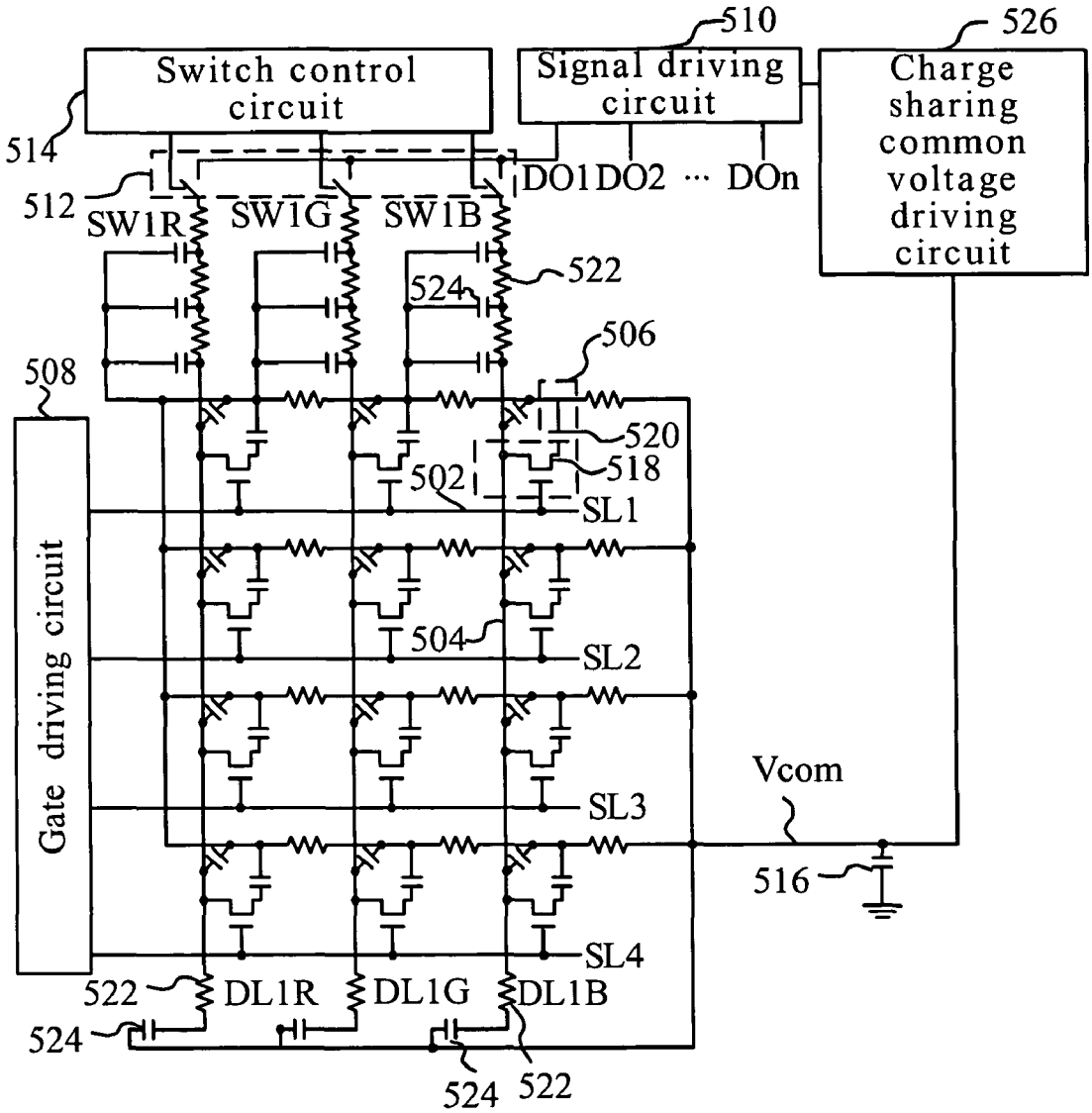
FIG. 5 is a schematic diagram of a TFT-LCD panel according to the invention.

FIG. 5 is a schematic diagram of a TFT-LCD panel according to the invention. As shown in FIG. 5, for convenient description, the panel includes four scan lines (SL1-SL4) 502, three data lines (DL1R, DL1G, DL1B) 504, twelve pixels 506, a gate driving circuit 508, a signal driving circuit 510, three switches (SW1R, SW1G, SW1B) 512, a switch control circuit 514, a common capacitor 516 and a charge sharing common voltage driving circuit 526.

For illustrative purpose, the number of scan lines and the number of data lines are four and three respectively. However, the number of scan lines and the number of data lines can be any number, for example, n and m, where n, m are positive integers.

The scan lines 502 are arranged in rows, and the data lines 504 are arranged in columns and intersect with the scan lines respectively. Each data line 504 has a parasitic resistor 522 and a parasitic capacitor 524. Each pixel 506 is located on an intersection of a scan line 502 and a data line 504, and has a transistor 518 and a capacitor 520 to store charges. The capacitor 520 has one terminal connected to a drain of the transistor 518 and the other terminal connected to a common voltage node Vcom. The transistor 518 has a source connected to a data line 504 and a gate connected to a scan line 502.

The signal driving circuit 510 produces a plurality of image signals. The switches 512 are coupled to the signal driving circuit 510 and the data lines 504. The switch control circuit 514 is connected to the switches 512 in order to produce a plurality of sampling signals to thereby control the switches to be on or off. When the switches are on, the image signals are sent to the data lines 504.

The gate driving circuit 508 is connected to the scan lines 502, which produces a switch voltage to the scan lines 502 in order to sequentially turn on the transistors 518 such that the switch control circuit 514 can sequentially switch the switches 512 on, and then the signal driving circuit 510 can send a gray voltage to the data lines 504 to charge the capacitors 520 through the respective transistors 518 until a target voltage is reached, thereby changing the transmittance of the respective liquid crystals (not shown).

The charge sharing common voltage driving circuit 526 is connected to the signal driving circuit 510. The common capacitor 516 has a first terminal connected to the pixels 506 and the charge sharing common voltage driving circuit 526 through a common voltage node Vcom, and a second terminal connected to ground. The charge sharing common voltage driving circuit 526 and the signal driving circuit 510 form a short circuit at charge sharing, and the switch control circuit 514 controls the switches 512 to be on in order to neutralize charges stored in the common capacitor 516 with charges on the data lines 504.

Figure 6:
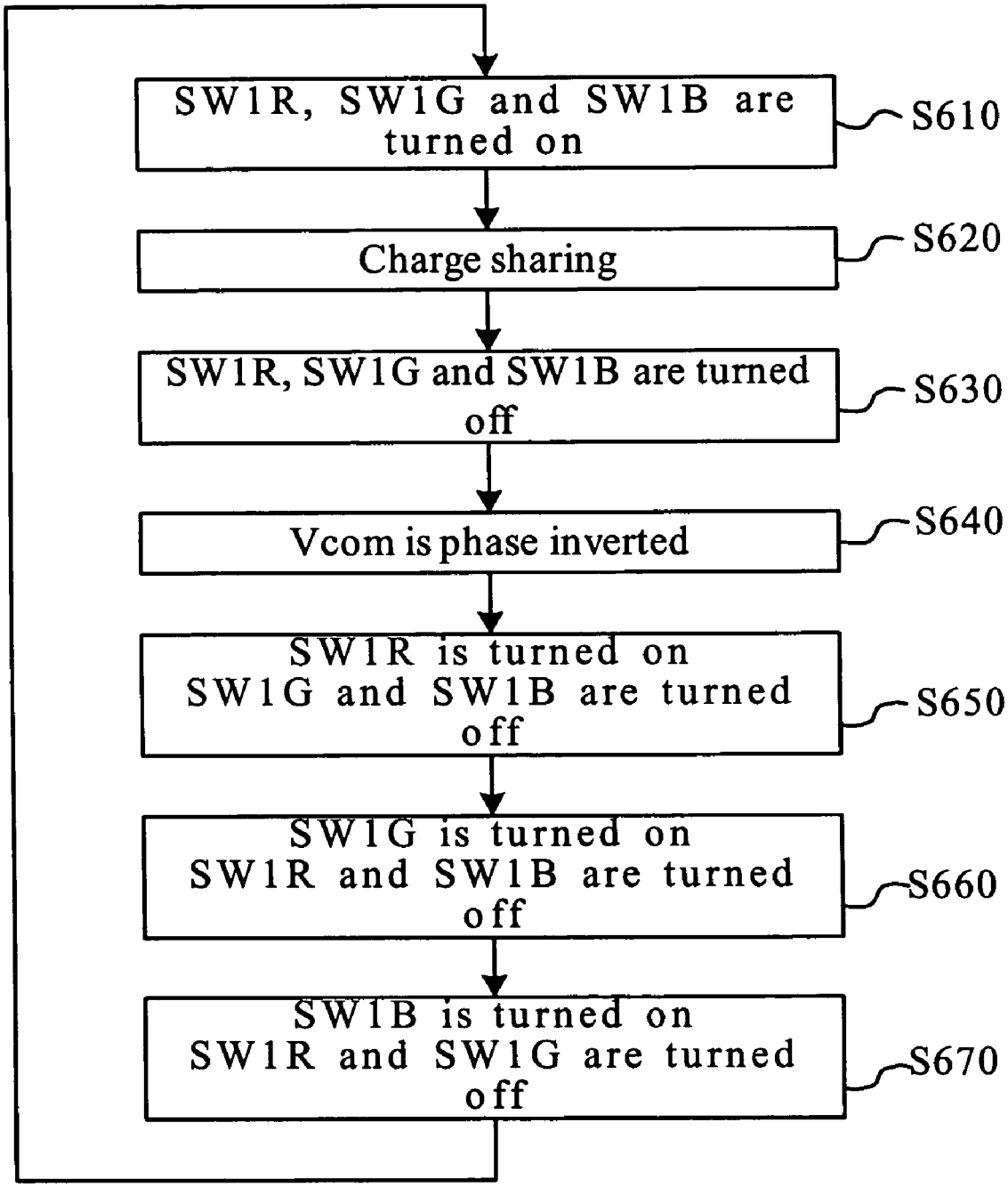
FIG. 6 is a flowchart of a preferred embodiment of the invention.
Figure 7:
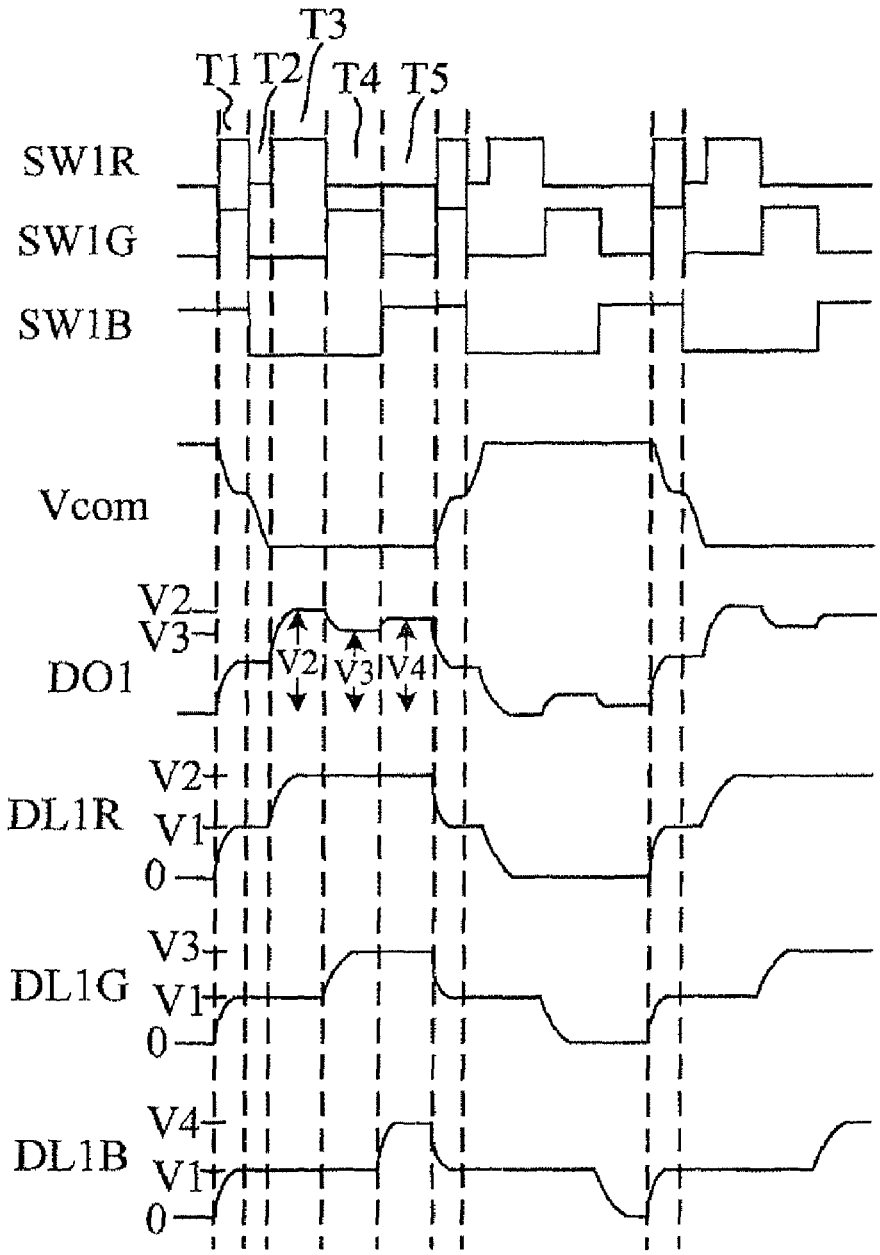
FIG. 7 is a diagram of waveforms on nodes according to the invention.

FIG. 6 is a flowchart of a preferred embodiment of the invention, and FIG. 7 is a diagram of waveforms on nodes according to the embodiment of FIG. 6. In step S610, the switch control circuit 514 controls the switches 512 to be on in a charge sharing trigger time, denoted as T1 as shown in FIGS. 6 and 7. In step S620, the charge sharing common voltage driving circuit 526 and the signal driving circuit 510 form a short circuit in order to neutralize charges stored in the common capacitor 516 with charges on the data lines 504 to a fixed voltage V1 in the charge sharing trigger time (T1).

In step S630, the charge sharing common voltage driving circuit 514 controls the switches 512 to be off in a switch-off time, denoted as T2 in FIG. 7, such that the voltages of the data lines 504 are remained at the fixed voltage V1.

In step S640, the charge sharing common voltage driving circuit 526 drives the node Vcom to be an inverse phase state, as T2 shown in FIG. 7. In steps S650, S660 and S670, the switch control circuit 514 sequentially switches the switches SW1R, SW1G, SW1B on/off in data driving time, denoted as T3, T4, and T5 in FIG. 7. The signal driving circuit 510 sequentially drives the data lines DL1R, DL1G, DL1B to voltages V2, V3, V4 respectively. Accordingly, as shown in FIG. 7, when the node Vcom changes its voltage from high to low, the voltages of the data lines DL1R, DL1G, DLIB are changed from V1 to V2, V3, V4, respectively, due to the charge sharing. This can save the power because the voltages are not changed from 0V to V2, V3, V4. In addition, since the signal driving circuit 510 requires driving the voltages of the data lines DL1R, DL1G, DL1B from V1 to V2, V3, V4, respectively, a transistor with a weaker driving capability can be used to save the cost. Further, because the voltages of the data lines DL1R, DL1G, DL1B are precharged to V1, the signal driving circuit 510 can take less time to drive the voltages from V1 to V2, V3, V4, thereby reducing the rising time of the data lines.

Figure 8:
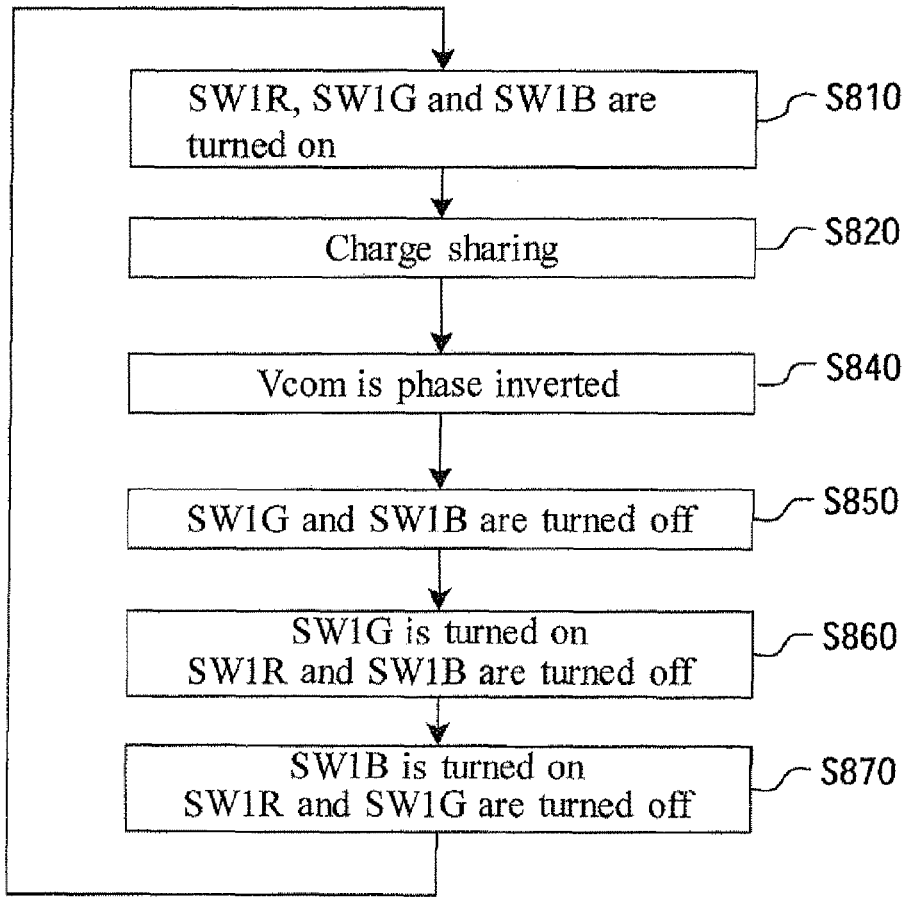
FIG. 8 is a flowchart of another preferred embodiment of the invention.

FIG. 8 is a flowchart of another preferred embodiment of the invention. Steps S810, S820, S840, S860 and S870 in this embodiment are similar to steps S610, S620, S640, S660 and S670 except that step S840 is executed immediately after step 820, i.e., the switches SW1R, SW1G, SW1B are still on in step S840. In step S850, the switches SWIG and SW1B are turned off.

In view of the foregoing, it is known that the invention makes the data lines and the node Vcom to be a short circuit to thereby obtain the charge sharing and reduce the power consumption required for the panel. In addition, the signal driving circuit 510 requires only driving the voltages of the data lines from V1 to V2, V3, V4 respectively, so that a transistor with weaker driving capability can be used to save the cost and to simplify the circuit.

Although the present invention has been explained in relation to its preferred embodiment, it is to be understood that many other possible modifications and variations can be made without departing from the spirit and scope of the invention as hereinafter claimed.

What is claimed is:

1. A liquid crystal display panel driving device with charge sharing, comprising:

a plurality of scan lines arranged in rows;

a plurality of data lines arranged in columns and intersected the scan lines respectively;

a plurality of pixels on intersections of the scan lines and the data lines;

a signal driving circuit to produce a plurality of image signals;

a plurality of switches coupled to the signal driving circuit and the data lines where the image signals are sent when the switches are on;

a switch control circuit, connected to the switches, for producing a plurality of sampling signals to control the switches to be on and off;

a charge sharing common voltage driving circuit connected between the signal driving circuit and a common voltage node; and a common capacitor having a first terminal connected to the pixels, the data lines, and the charge sharing common voltage driving circuit through the common voltage node, and a second terminal connected to ground, wherein the switch control circuit controls the switches to be on and the charge sharing common voltage driving circuit and the signal driving circuit form a short circuit for charge sharing so as to neutralize charges stored in the common capacitor with charges on the data lines and remain at a fixed voltage for the data lines during driving the data lines of the pixels in a charge sharing trigger time, and the charges stored in the common capacitor reach the plurality of data lines through both the charge sharing common voltage driving circuit and the signal driving circuit at said charge sharing without using additional pre-charging switch transistor.

2. The liquid crystal display panel driving device as claimed in claim 1, wherein the charge sharing common voltage driving circuit controls a voltage of the common voltage node.

3. The liquid crystal display panel driving device as claimed in claim 2, wherein when the common voltage node changes its voltage from high to low, the voltages of the data lines are changed from V1 to V2, V3 and V4 respectively.

4. The liquid crystal display panel driving device as claimed in claim 1, wherein the charge sharing common voltage driving circuit controls the plurality of switches to be off in a switch-off time, such that the voltages of the data lines are remained at the fixed voltage.

5. The liquid crystal display panel driving device as claimed in claim 4, wherein the voltages of the plurality of data lines are changed from the fixed voltage in data driving time.

6. The liquid crystal display panel driving device as claimed in claim 1, wherein the liquid crystal display panel applies a common voltage swing drive method.

7. The liquid crystal display panel device as claimed in claim 1, wherein the charges stored in the common capacitor reach the plurality of data lines through both the charge sharing common voltage driving circuit and the signal driving circuit directly at charge sharing.

8. A driving method with charge sharing for a liquid crystal display panel, the liquid crystal display panel including a plurality of switches, a plurality of data lines, a signal driving circuit to produce a plurality of image signals, a charge sharing common voltage driving circuit connected between the signal driving circuit and a common voltage node, and a common capacitor having one terminal connected to the pixels, the data lines, and the charge sharing common voltage driving circuit through the common voltage node and the other terminal connected to ground, the method comprising the steps of:

turning the switches on;

forming the charge sharing common voltage driving circuit and the signal driving circuit to be a short circuit in order to neutralize charges stored in the common capacitor with charges on the data lines and remain at a fixed voltage for the data lines during driving the data lines of the pixels in a charge sharing trigger time, wherein the charges stored in the common capacitor reach the plurality of data lines through both the charge sharing common voltage driving circuit and the signal driving circuit at charge sharing;

driving the common voltage node to be in an inverse phase; and sequentially turning the switches on and then off to accordingly drive voltages of the data lines from the fixed voltage respectively.

9. The driving method as claimed in claim 8, wherein the step of forming the charge sharing common voltage driving circuit and the signal driving circuit to be a short circuit further comprises a step of:

turning the switches off simultaneously.

10. The driving method as claimed in claim 8, wherein the charge sharing common voltage driving circuit controls a voltage of the common voltage node.

11. The driving method as claimed in claim 10, wherein when the common voltage node changes its voltage from high to low, the voltages of the data lines are changed from V1 to V2, V3 and V4 respectively.

12. The driving method as claimed in claim 8, wherein the liquid crystal display panel applies a common voltage swing drive method.

13. A driving method with charge sharing for a liquid crystal display panel, the liquid crystal display panel including a plurality of switches, a plurality of data lines, a signal driving circuit to produce a plurality of image signals, a charge sharing common voltage driving circuit connected between the signal driving circuit and a common voltage node and a common capacitor having a terminal connected to the sharing common voltage driving circuit through the common voltage node, the method comprising the steps of:

turning the switches on;

forming the charge sharing common voltage driving circuit and the signal driving circuit to be a short circuit to neutralize charges stored in the common capacitor with charges on the data lines and remain at a fixed voltage for the data lines during driving the data lines of the pixel in a charge sharing trigger time, wherein the charges stored in the common capacitor reach the plurality of data lines through both the charge sharing common voltage driving circuit and the signal driving circuit directly at charge sharing;

driving the common voltage node to be in an inverse phase; and sequentially turning the switches on and then off to accordingly drive voltages of the data lines from the fixed voltage respectively.

* * * * *